United States Patent [19]

Watkins

[11] Patent Number: 5,038,530

[45] Date of Patent: Aug. 13, 1991

[54] ARRANGEMENT FOR ENTRAPPING DEBRIS ON A SCREEN UPPER SURFACE AND REMOVING SAME FROM UNDERNEATH THE UPPER SURFACE

[76] Inventor: Charles E. Watkins, 3303 N. Lakeview Dr., Apt. #2709, Tampa, Fla. 33618

[21] Appl. No.: 609,692

[22] Filed: Nov. 2, 1990

[51] Int. Cl.[5] ..... E04B 1/12

[52] U.S. Cl. ..... 52/63; 52/12; 52/14

[58] Field of Search ..... 52/12, 13, 14, 15, 63; 210/163, 164, 474

[56] References Cited

U.S. PATENT DOCUMENTS

| | | | |
|---|---|---|---|
| 2,765,362 | 10/1956 | Lindgren | 52/63 |
| 2,765,498 | 10/1956 | Kelnhofer | 52/63 |
| 2,883,712 | 4/1959 | Shelamer | 52/63 |
| 4,036,761 | 7/1977 | Rankin | 210/474 |

*Primary Examiner*—Richard E. Chilcot, Jr.
*Assistant Examiner*—Wynn E. Wood
*Attorney, Agent, or Firm*—D. D. McGraw

[57] ABSTRACT

A screened enclosure such as that commonly used to cover lanais, swimming pools, outdoor dining areas and the like has supports for overhead screening. Typically the supports are a series of roof arches joined by cross beams, and fixed screening is secured to the upper surfaces of these supports. The enclosure includes removable screen sections which are removably secured to under surfaces of these supports or the under surfaces of specially provided screen support members. These under surfaces to which the removable screen sections are removably secured define several perimeter sections which are usually but not always rectangular, with a separate removable screen section for each of those perimeter sections. When a removable screen section is removed, partially or completely, it is removed from underneath the screened enclosure so that no one has to climb above the screened enclosure to reach and remove debris. The removed screen section provides an access opening through which the debris collected thereon is removed, as well as debris on or in adjacent structure such as the fixed screen sections and a roof gutter. Hook-and-loop fastening strips are the preferred means for fastening the removable screen sections to the support structures.

13 Claims, 2 Drawing Sheets

ARRANGEMENT FOR ENTRAPPING DEBRIS ON A SCREEN UPPER SURFACE AND REMOVING SAME FROM UNDERNEATH THE UPPER SURFACE

FIELD OF THE INVENTION

The invention relates to structure accommodating the collection and removal of debris from the upper surfaces of a screen enclosure and adjacent structure such as roof gutters, with access by which the debris is removed being from within the screened enclosure.

BACKGROUNG OF THE INVENTION

It is well recognized among persons who install screened enclosures, persons who have them, and persons who write about maintenance in newspapers and other publications that debris such as falling leaves, needles, and twigs from nearby trees, plus debris deposited by wind and rain, all accumulate on overhead screening. This is true whether the screening is of the typical metallic or plastic-strand woven or other open matrix type which is used to limit the entry insects while permitting air flow therethrough, or is a solid sheet screening intended to prevent entry of air or rain, for example, as well as insects. Screening of the latter type is often used to form temporary greenhouses, for example.

The accumulated debris not only produces weight and strain, but when allowed to remain for long periods induces the rotting of fiberglass screening and rusting of metallic screening. Pine needles accumulate very quickly and are particularly difficult to remove, as they tend to pierce through the woven or other open matrix screen openings and stubbornly stay put. Leaves and needles also become wedged under gutters where the screening is beneath and close to or even engaging the bottom sides of the gutters. If the overhead screening does not cover all areas of a patio or deck, each rain or even high winds washes or blows some of the debris onto the patio or deck. Without side screening, some of this debris is often washed or blown into swimming pools, spas and the like, increasing the cleaning and maintenance required.

Large accumulations of debris on the upper surface of the overhead screening and in adjacent gutters require hand removal for the worst of it. This typically means climbing up to the upper side of the overhead screening, placing boards across the supporting framework, and laboriously moving the debris from one screen panel or section to the other until the debris is removed. Even if the debris on the overhead screening near the building eave, and debris in the rain gutters, is to be removed, it involves climbing up on the building roof, walking near the edge, bending over and manually removing the debris, placing it in an appropriate container, and then bringing the filled container and oneself safely back to ground. Even if this is successfully and safely accomplished, some types of roofs are easily damaged by walking on them. Such roofs include tile roofs, which are also common in areas where screen enclosures are popular. Some roof shapes defy efforts to reach the debris. Also, climbing on such boards and roofs is not only difficult but dangerous to most homeowners.

One typical solution advocated and used by homeowners and by writers on the subject has been to turn on a water hose, set the nozzle for a strong stream, stand beneath the screening and wash the debris off of the overhead screening. Advice columns in newspapers and magazines have suggested that this is best accomplished by starting at one side of the screening where it is attached to the building, then progress systematically from one screen panel to the next. This sends decaying vegetation flying and tumbling around. The person controlling the hose has to try to drive the debris from screen panel to screen panel toward the far end of the enclosure and away from the building roof and gutters. This procedure is not only time consuming, but wastes water, one of our more precious natural resources. In the process it wets debris which is not removed, increasing the potential damage to the screening and other structure supporting the soaked debris, provides a haven for some insects, and often becomes moldy. Mold will stain, create bad odors, and increase the nuisance generally.

Another solution has been to use a portable leaf blower. directing the air stream at the debris through the screening. This entrains the debris in the air flow, scatters it all over, and with much labor eventually blows most of the debris off of the screening. In so doing, as with the water hose, some of the debris will simply be relocated from the screening, and will often land on the building roof and in its rain gutters. The gutters become plugged up with this additional debris, and the water backs up in them, causing water damage to the lower ends of the building eaves as well as encouraging oxidation of the gutters.

Homeowners have been interviewed about the problem, and they universally use one of the above noted methods of removal. Many just consider it to be too difficult a job, and hire someone to climb on top of the roof and the screening so as to remove the debris. All have said that they would like a simpler and easier solution if one were available. Manufactures and installers of screen enclosures would also like to have such a solution that they could incorporate into their products.

SUMMARY OF THE INVENTION

The invention herein disclosed and claimed relates to screened enclosures such as those commonly covering lanais, swimming pools, decks, and similar structures. Such screened enclosures are particularly popular in warmer climates where there is no winter snow, but numerous insects. Many municipalities require such screen enclosures for swimming pools. The invention also relates to solid-sheet screened enclosures or overhead screening such as temporary greenhouses and other screen structures employing imprevious screening to prevent air or rain entry, and the like. Such overhead screening is more fully discussed above.

The invention more particularly relates to an arrangement which supports debris collected on some of the upper surfaces of the overhead screening and areas immediately adjacent to that screening, with portions of the screening being partially or totally removable from the underneath side of the overhead screening. When any one of such portions is so removed, the debris collected on it is removed through the opening created by the removal, and debris on adjacent structures such as fixed overhead screening areas, roofs and gutters is accessible for removal through the opening.

In the preferred embodiments, there are fixed overhead screen sections which are usually pitched so that debris such as leaves, twigs, and trash blown on the screening will slide or be blown to other overhead screen sections which are at the lower edges of the pitched sections. These other screen sections are preferably in horizontal planes or have a relatively slight pitch so that the debris does not tend to slide onto other parts of the enclosure screening. Also, these other screen sections are preferably located at low areas, usually next to gutters or roof edges or relatively narrow sections of fixed overhead screening, so that the debris tends to be trapped. Such debris will therefore collect on these other overhead screen sections as well as the other adjacent structures, due to wind currents and rain. Some or all of these other overhead screen sections are removably attached to underside surfaces so that these sections may be individually removed to create access openings for removal of the debris, and they may be reattached so that they again collect and hold debris until they are again removed.

Attachment is preferably accomplished by hook-and-loop tapes on the other periphery of each removal screen section and the mating surfaces to which the screen section is attached. One or more handles may be provided on the lower side of the removable screen section. Such handles are easily pulled to separate the hook-and-loop fasteners, even while standing on a ladder or stool.

DETAILED DESCRIPTION

Figure 1:
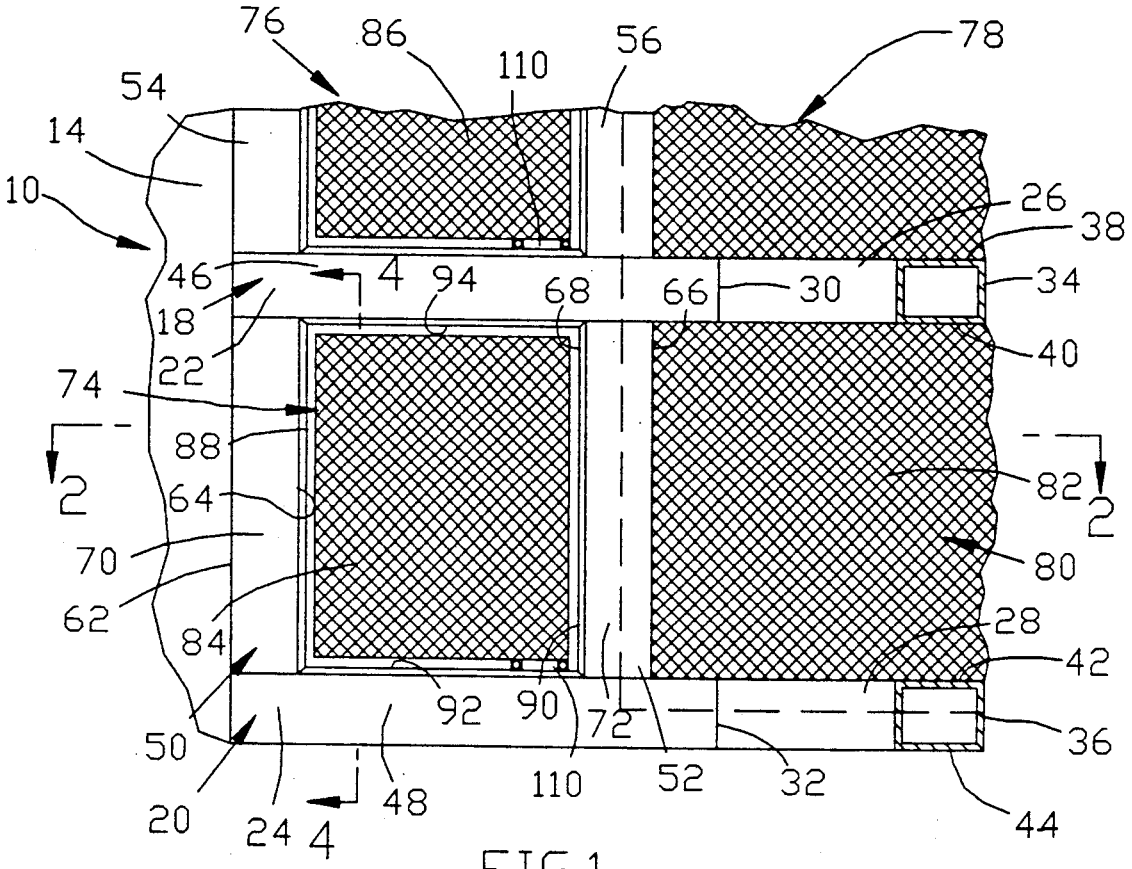
FIG. 1 is a plan view of the underside of a portion of a screened enclosure embodying the invention, with parts broken away and in section. It is taken in the direction of arrows 1—1 of FIG. 2.

The invention is illustrated as being applied to a screened enclosure having overhead portions on which debris commonly collects. It is to be understood that it may also be applied to other articles of manufacture having a problem of debris collection in areas where the debris is not readily accessible from the debris-collecting side, but is or can be made accessible from the underside of the overhead screen sections on which the debris has collected.

The screening enclosure overhead portion 10 shown in the various drawing figures is typical of a portion of a screened pool enclosure found in the warmer climates such as the southern United States. Such installations use woven screening, usually woven with plastic strands. It is shown as having been installed immediately adjacent to a gutter 12 which is attached to the eave 14 of a building roof 16. The screening enclosure overhead portion 10 includes transverse screen support beams or roof arches 18 and 20 which are spaced apart much like roof trusses are in building roof support systems. These beams or arches are shown as having horizontal sections 22 and 24 and upwardly angled sections 26 and 28 respectively connecting with the horizontal sections at 30 and 32. Beams 18 and 20 are illustrated as being hollow box sections respectively having upper surfaces 34 and 36, side surfaces 38, 40 and 42, 44, and bottom surfaces 46 and 48.

Beams or arches 18 and 20 have cross beams 50 and 52 secured to them which hold the transverse beams in properly spaced relation and add rigidity, strength and support. Of course, in the complete screening enclosure framework, there are more transverse arches and cross beams than those shown in the drawing. Cross beams 54 and 56, parts of which are shown, are two of such additional beams. Cross beams 50 and 52 will be described further, but it is to be understood that cross beams 54 and 56, and other such cross beams, have similar features. Cross beams 50 and 52 are also illustrated as having box cross sections, and they respectively have upper surfaces 58 and 60, side surfaces 62, 64 and 66, 68, and bottom surfaces 70, 72. In the particular construction shown, cross beam 50 has the same cross section size and shape as do beams or arches 18 and 20, while cross beam 52 is smaller in cross section. Beam surfaces 34 and 36 are in planar alignment with the upper surfaces 58 and 60 of the of the support beam horizontal portions 22 and 24. However, because the beams 50 and 52 are smaller, their bottom surfaces 70 and 72 do not extend to the plane of the bottom surfaces 46 and 48 of beams 18 and 20. Of course, beams 50 and 52 may be made the same size as beams 18 and 20, and their bottom surfaces would then be in the same plane as the bottom surfaces of beams 18 and 20.

Structural elements such as beams 18, 20, 50 and 52 cooperate to define perimeter sections, one such complete perimeter section 74 being shown in FIG. 1, as well as portions of other perimeter sections 76, 78, and 80. All of these perimeter sections are illustrated as being rectangles, and that configuration is the most common. However, they may hve other geometric configurations, or even combinations of parts of a plurality of geometric configurations. Large fixed screen sections such as screen section 82 usually cover several of the first group of perimeter sections such as perimeter sections 78 and 80. These fixed screen sections are suitably secured to the upper surfaces of the transverse and cross beams in a well-known manner not illustrated.

A second group of perimeter sections are those which have the removable screen sections. These include the illustrated perimeter sections 74 and 76. The removable screen sections 84 and 86 respectively cover these two perimeter sections and are secured to support surfaces on the beam structures. The removable screen sections may form a substantially continuous line of such sections, or the removable sections may be separated by fixed sections. It so separated, they should be sufficiently close together so that any debris on them can be reached and removed in accordance with the invention, as needed.

For the sake of brevity and simplicity, further description is directed to perimeter section 74 and removable screen section 84. It is to be understood, however, that this description also applies to other removable screen sections and their associated perimeter sections.

Figure 2:
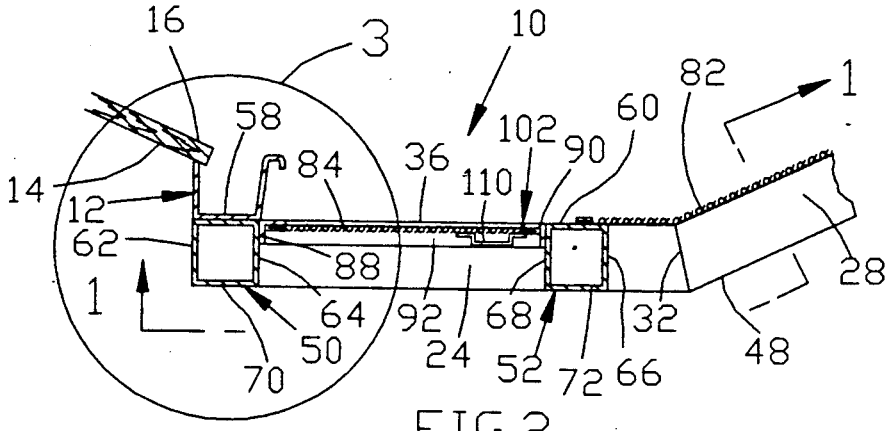
FIG. 2 is a cross section view of the structure of FIG. 1, taken in the direction of arrows 2—2 of that figure and having parts broken away.
Figure 3:
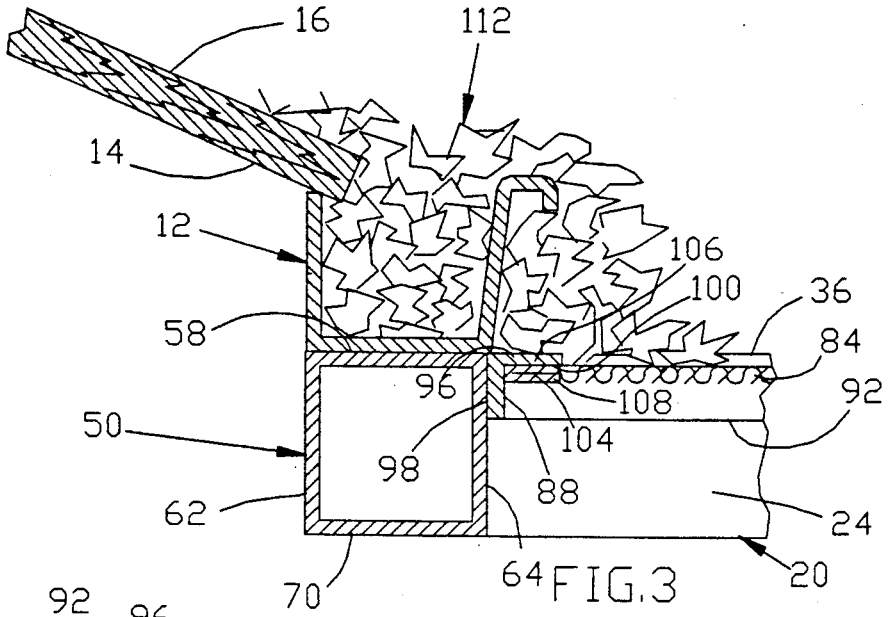
FIG. 3 is an enlarged portion of a part of FIG. 2 as identified by the circle 3 on that figure.
Figure 4:
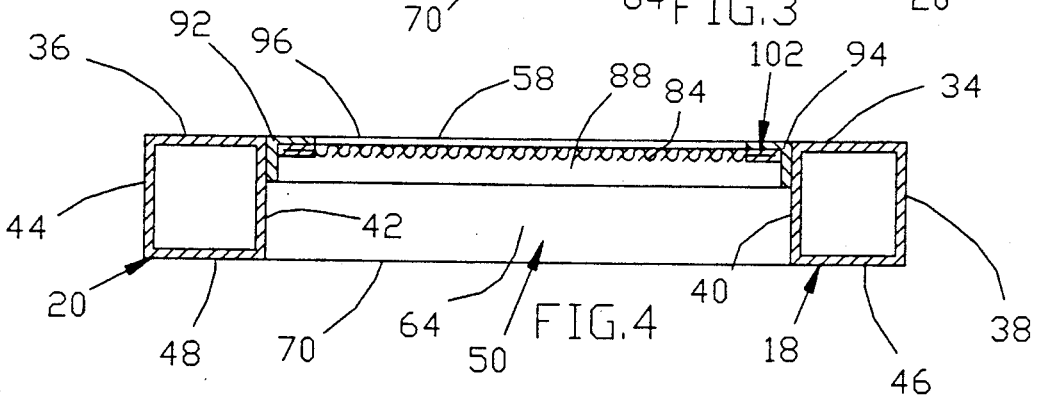
FIG. 4 is a cross section view of the structure of FIG. 1, taken in the direction of arrows 4—4 of that figure, with parts broken away.
Figure 5:
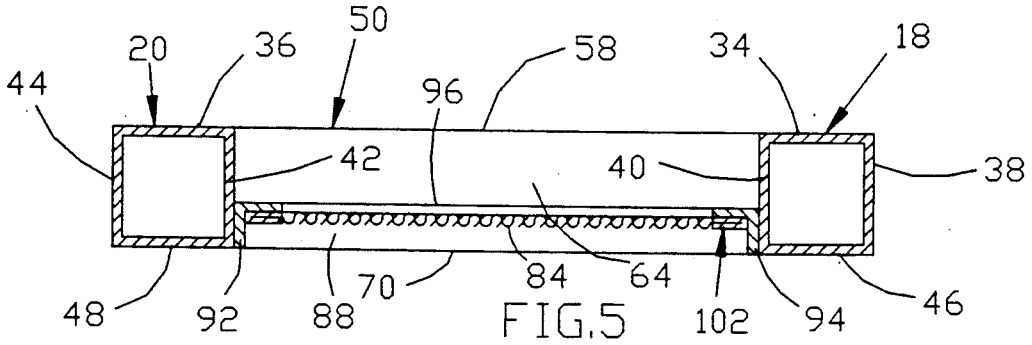
FIG. 5 is a cross section view like that of FIG. 4, showing another embodiment of the invention.

In FIGS. 2, 3 and 4, the embodiment of the invention is specifically shown wherein the removable screen section 84 lies substantially in the plane of the adjacent part of the fixed screen section 82. In FIG. 5, the embodiment of the invention is specifically shown wherein the removalbe screen section 84 is substantially in or just above the plane of the bottom surfaces 46 and 48 of beams 18 and 20. The bottom surfaces 70 and 72 of beams 50 and 52 also are in the plane of surfaces 46 and 48. For this arrangement, cross beam 52 is also the same cross-section size as beams 18 and 20.

While it is within the scope of the invention for the removable screen section 84 to be mounted on the bottom surfaces of the beams in the embodiment shown in FIG. 5, both embodiments are illustrated as having separate support members within the perimeter section 74 to which removable screen section 84 is mounted. These support members are preferably made of "angle iron" sections, recognizing that they are not usually made of iron, but more commonly of anodized aluminum, as are most of the beams in use in recent installations. For such support members 88, 90, 92 and 94 are shown in perimeter section 74. They are arranged as shown in greater detail in FIG. 3, where portions of the two support members 88 and 92 are visible. They have their upper outer surfaces flush with the upper surfaces of the beams defining perimeter section 74, and their outer side surfaces in secured mounting contact with the inner side surfaces 64, 40, 68, and 42 of those beams. Thus support member 88 has its upper outer surface 96 flush with upper surface 58 of cross beam 50, and outer side surface 98 in secured mounting contact with inner side surface 64 of beam 50. The support members preferably have their ends abutting their adjacent side members so that they form a surface mounting platform within the perimeter section 74 for securing removable screen 84 in place. Support members 88, 90, 92, and 94 also have upper inner surfaces, with the upper inner surface 100 of support member 88 being best seen in FIG. 3. A fastener arrangement 102, shown in these preferred embodiments as a hook-and-loop arrangement known by such trademark names as Velcro and Scotchmate, is used to attach screen 84 to the support surfaces defined by the upper inner surfaces of the support members such as surface 100. In the particular embodiments shown, fastener arrangement 102 is formed of four sets of strips of the hook-and-loop material, with each set having a hoop strip and a loop strip. The strips of each set of strips are sufficiently close together, end-to-end fashion, they they form a substantially continuous rectangular loop. In quantity production, the loop so formed may be a continuous, uninterrupted strip set or a lesser number of strip sets, preshaped to extend over larger portions of the loop.

One set of strips 104 of hook-and-loop material is seen in cross section in FIG. 3. It has a hook strip 106 and a loop strip 108, with one of them (in this case the hook strip 106) secured to support member upper inner surface 100 by suitable means such as gluing, and the other one secured to the upper outher peripheral edge of removable screen section 84 by suitable means such as gluing or stitching, or both. Strips 106 and 108 are in substantially full mating relation so that the screen section 84 can be placed in position, and full interengaging action of the hook and loop strips can be obtained by simply applying hand pressure to the underside of the screen section 84 under the strip 108, as is well known.

In this manner, screen section 84 is secured to the framework from underneath, and can be removed from underneath as well. To assist in removal, one or more suitable handles or other attachemnts 110 may be attached to the underside of screen section 84, preferably under one of the strips 108, so that by manually exerted downward pulling force on one or more of the handles, the hook and loop strips are separated and the screen section, or only part of it if desired, is removed from the perimeter section 74. This provides an access opening where the removed screen section or part of it had been secured, through which one may readily remove the debris 112, shown somewhat schematically as leaves and twigs, may be removed. One may desire to hold a container underneath the area being opened so that the debris lying on screen section 84 simply falls into the container. Any debris in the area of the opening which on the adjacent fixed screen section 82, or, as shown, is within the gutter 12, can be readily removed by way of the access opening. After the debris has been removed, the screen section 84 is returned to its secured mounting position within perimeter section 74. It is then able to once again collect debris and hold it until the next removal.

In the embodiment of FIG. 5, removable screen section 84 is mounted on lower co-planar surfaces of the support members. As illustrated, these co-planar surfaces are the upper inner surfaces of the support members 88, 90, 92 and 94, as in FIG. 4. When desired, the support members may be inverted in relation to the installation in the other Figures. In such an inversion, the formerly upper outer surface 96 of support member 88 becomes the lower outer surface, and the fastening arrangment strip 106 is fastened to it instead of to an inner surface of the support member. In that instance, the surface 96 of the support member may either be flush with the bottom surfaces of the beams, or may be recessed slightly into the perimeter section 74 so that the removable screen section 84, when installed in its secured position, is substantially contained within the perimeter section. Whether the support members are secured as shown in FIG. 5 or inverted, the removable screen section 84 is adjacent to or substantially flush with the bottom surfaces of the beams.

This slightly recessed arragement has certain advantages. For example, it moves the adjacent outer edge surfaces of the hook-and-loop strips into areas protected from the direct blast of heavy winds, lessening the tendency of the strips to have forces exerted thereon by high winds, which forces might cause the removable screen section 84 to become detached.

In the FIG. 5 embodiment, the screen section 84 and the beam side surfaces 40, 42, 64, and 68 cooperate to provide a recessed space which provides better entrapment and containment of any debris which falls into the recessed space than does the upper flush arrangment of the other figures. In both embodiments, the debris is accessed and removed entirely from underneath the overhead screening, with the result that removal and replacement of the removable screen sections is quickly and easily accomplished, also from underneath the overhead screening.

It has been found that one-inch wide strips of Scotchmate brand hook-and-loop fastening material, a product of 3M Corporation of Minneapolis, Minn., perform quite satisfactorily. One side or strip portion is precoated with adhesive which will hold the strip sections to the support surfaces, and the other side or strip is readily sewn to the outer periphery of the removable screen section. It may also be fastened with adhesive, preferably together with being sewn.

The same type of woven open matrix screening that is typically used on such screened enclosures may be used for the removable screen sections. However, it has been found that a somewhat stronger open matrix screen material is better able to withstand the load of the debris under various conditions. such a screen material is manufactured by Phifer Wire Products of Tuscaloosa, Ala., under the trademark SheerWeave. It has about 14% openness, is composed of 500 denier fiberglass, PVC coated in the warp, and 1000 denier polyester, PVC coated in the fill. It is flame retardant and comes in a variety of decorator colors. Unlike some bulky metal grids used to keep leaves and other debris out of gutters, these products are very light in weight and do not add heavy weights which have to be supported by the gutters. These products have been found to adequately resist the wheather conditions usually encountered where such open weave screened enclosures are commonly used, at least to the same extent that the usual fixed screening enclosures maintain their integrity and remain functional under heavy rain and wind conditions. They have been found to have sufficient retention power to hold the kinds of debris typically encountered, as earlier mentioned.

The invention solves the long-exisiting problem of how to remove debris from the upper side of overhead screen enclosures by arranging for its removal from underneath the overhead scrrening through temporary access openings in the screening rather than trying to blow or rinse it off, or climbing on top manually remove it.

What is claimed is:

1. in a screened enclosure having overhead screening and adjacent structure subject to collection and entrapment of debris such a leaves, small tree limbs, paper, plastic discards, etc., on the upper sides of at least portions thereof, the improvement comprising:

first means for supporting the collected and entrapped debris on the upper surfaces of the overhead screening and adjacent structure and preventing said debris from entering the screened enclosure, said first means including fixed screen sections and removable screen sections;

support means for said first means including transverse screen support beams and cross beams joining said transverse beams to provide first perimeter sections and second perimeter sections, said fixed screen sections being secured to certain sections of said support means defined by portions of said transverse beams and said cross beams, said fixed screen sections covering said first perimeter sections;

said support means further including support surfaces for said removable screen sections, said support surfaces being within said second perimeter sections;

fastening means for removably securing said removable screen sections to said support surfaces, said fastening means having first and second portions; said first and second portions cooperatively interengage;

each of said removable screen sections being shaped to cover one of second perimeter section including said support surfaces within the one of said second perimeter sections, each of said support surfaces to which a removable screen section is secured having said first portion of said fastening means attached thereto and each of said removable screen sections having said second portion of said fastening means attached thereto around its perimeter in mating relation with said first portion of said fastening means so that said portions are interengaged in fastening relation and secure each of said removable screen sections to said support surfaces within the one of said second perimeter sections covered by the one of said removable screen section;

at least a part of each of said removable screen sections being controllably removable from under side of the screen enclosure within the screen enclosure and permitting the removal of debris supported by said removable screen sections and by adjacent structure which is made accessible through the openings provided by such removal;

said removable screen sections collecting debris on the upper sides thereof over a period of time and preventing entry of debris into the screened enclosure through said perimeter sections and resisting removal due to natural forces such as wind, rain and the weight of the collected debris, said removable screen sections when at least partially removed from being secured for removal of debris therethrough which has collected on said removable screen sections and adjacent structure including adjacent fixed screen sections, and said removable screen sections when replaced and resecured to said support means again preventing said entry of debris and resisting screen removal due to natural forces.

2. The improvement in a screened enclosure as defined in claim 1 in which said fastening means are hook-and-loop fastening means and each of said fastening means comprises a hook portion and a loop portion, said first portion of said fastening means being one of said hook portions and loop portions, said first portion of said fastening means also being permanently secured to said support surfaces by a permanent adhesive, said second portion of said fastening means being the other of said hook portions and loop portions and being permanently secured to one of said removable screen sections, said first and second portions of said fastening means being in hook-and-loop fastening enagement holding said the one of said removable screen sections to said support surfaces.

3. The improvement in a screened enclosure as defined in claim 1 in which said adjacent structure includes a roof gutter which also collects debris, at least one of said removable screen sections being so accesibly positioned adjacent said roof gutter that when said at least one of said removable screen sections is removed to provide said underside access the debris in said roof gutter may be removed through said underside-access opening.

4. in a screened enclosure having overhead screening and adjacent structure subject to collection and entrapment of debris such as leaves, small tree limbs, paper, plastic discards, etc., on the upper sides of at least portions thereof, the improvement comprising:

first means for supporting the collected and entrapped debris on the upper surfaces of the overhead screening and adjacent structure and preventing said debris from entering the screened enclosure, said first means including fixed screen sections and removable screen sections;

support means for said first means including transverse screen support beams and cross beams joining said transverse beams to provide first perimeter sections and second perimeter sections, said fixed screen sections being secured to certain sections of said support means defined by portions of said transverse beams and said cross beams, said fixed screen sections covering said first perimeter sections;

said support means further including support surfaces for said removable screen sections, said support surfaces being within said second perimeter sections;

fastening means for removably securing said removable screen sections to said support surfaces, said fastening means having cooperatively interengaging first and second portions;

each of said removable screen sections being shaped to cover one of second perimeter sections including said support surfaces within the one of said second perimeter sections, each of said support to which a removable screen section is secured having said first portion of said fastening means permanently secured thereto and each of said removable screen sections having said second portion of said fastening means permanently secured thereto around its perimeter in mating relation with said first portion of said fastening means so that said portions are interengaged in fastening relation and secure each of said removable screen sections to said support surfaces within the one of said second perimeter sections covered by the one of said removable screen sections;

and means manually graspable for controllably removing at least a part of each of said removable screen sections from the under side of and within the screen enclosure and permitting the removal of debris supported by said removable screen sections and by adjacent structure which is made accessible through the openings provided by such removal;

said removable screen sections collecting debris on the upper sides thereof over a period of time and preventing entry of debris into the screened enclosure through said perimeter sections and resisting removal due to natural forces such as wind, rain and the weight of the collected debris, said removable screen sections when at least partially removed from being secured to said support means providing an underside-access opening for removal of debris therethrough which has collected on said removable screen sections and adjacent structure, and said removable screen sections when replaced and resecured to said support means again preventing said entry of debris and resisting screen removal due to natural forces.

5. The improvement in a screened enclosure as defined in claim 4 in which said support surfaces are so positioned as to mount said removable screen sections in substantial surface continuity with said fixed screen sections.

6. The improvement in a screened enclosure as defined in claim 4 in which said support surfaces are so positioned as to mount said removable screen sections out of and below substantial surface continuity with said fixed screen sections, each of said removable screen sections and those of said support means which provide each of said second perimeter sections cooperating to define a recessed space which tends to retain debris collected on the upper side of each of said removable screen sections so that debris to be removed tends to be concentrated on said removable screen sections.

7. The improvement in a screened enclosure as defined in claim 4 in which said support surfaces are provided at least in part by support members secured to certain other sections of said support means within said second ones of said perimeter sections.

8. The improvement in a screened enclosure as defined in claim 7 in which said support members are formed by rightangled strips each having an outer surface engaging and secured to said support means and an inner surface at a right angle to said outer surface to which said first portion of said fastening means is permanently secured.

9. The improvement in a screened enclosure as defined in claim 7 in which said support members are formed by rightangled strips each having a first outer surface engaging and secured to said support means and a second outer surface at a right angle to said first outer surface to which said first portion of said fastening means is permanently secured.

10. The improvement in a screened enclosures as defined in claim 4 in which said fastening means are hook-and-loop fastening means and each of said fastening means comprises a hook portion and a loop portion, said first portion of said fastening means being one of said hook portions and loop portions, said first portion of said fastening means also being permanently secured to said support surfaces by a permanent adhesive, said second portion of said fastening means being the other of said hook portions and loop portions and permanently secured to one of said removable screen sections, said first and second portions of said fastening means being in hook-and-loop fastening engagement holding said the one of said removable screen sections to said support surfaces.

11. The improvement in a screened enclosure as defined in claim 4 in which said removable screen sections are in substantially horizontally extending planes and said fixed screen sections which are immediately adjacent said removable screen section are in planes inclined to the horizontal which are angled upwardly from the plane of said removable screen sections so that at least some of the debris initially collecting on said fixed screen sections tends to slide from said fixed screen sections onto said removable screen sections.

12. The improvement in a screened enclosure as defined in claim 4 in which said adjacent structure includes a roof gutter which also collects debris, said removable screen sections being so accessibly positioned adjacent said roof gutter that underside access the debris in said roof gutter may be removed through said underside-access opening.

13. The improvement in a screened enclosure as defined in claim 4 in which said adjacent structure includes a roof gutter and at least one of said fixed screen sections which also collect debris, at least one of said removable screen sections being so accessibly positioned adjacent said roof gutter and said at least one of said fixed screen sections that when said at least one of said removable screen sections is removed to provide said underside access the debris in said roof gutter and said at least one of said fixed screen sections may be accessed and removed through said underside-access opening.

* * * * *